US006280227B1

(12) United States Patent
Terada et al.

(10) Patent No.: US 6,280,227 B1
(45) Date of Patent: Aug. 28, 2001

(54) ELECTRICAL CONNECTOR WITH LOCKING MECHANISM AND METAL SPRING

(75) Inventors: Takashi Terada, Atsugi; Toshihiro Niitsu, Yokohama, both of (JP)

(73) Assignees: Molex Incorporated, Lisle, IL (US); Sony Corporation, Tokyo (JP)

( * ) Notice: Subject to any disclaimer, the term of this patent is extended or adjusted under 35 U.S.C. 154(b) by 0 days.

(21) Appl. No.: 09/492,017

(22) Filed: Jan. 26, 2000

(30) Foreign Application Priority Data

Jan. 26, 1999 (JP) ..... 11-016837
May 31, 1999 (JP) ..... 11-152484

(51) Int. Cl.[7] ..... H01R 13/627
(52) U.S. Cl. ..... 439/357; 439/607
(58) Field of Search ..... 439/357, 358, 439/350, 352, 939, 101, 108, 92, 95, 607

(56) References Cited

U.S. PATENT DOCUMENTS

| | | | | |
|---|---|---|---|---|
| 4,516,815 | * | 5/1985 | Venable et al. | 439/607 |
| 4,641,902 | | 2/1987 | Fusselman | 339/91 |
| 4,699,438 | * | 10/1987 | Kikuta | 439/607 |
| 5,154,629 | * | 10/1992 | Carver et al. | 439/607 |
| 5,338,227 | * | 8/1994 | Nakamura | 439/607 |
| 5,340,329 | * | 8/1994 | Hirai | 439/357 |
| 5,449,298 | | 9/1995 | Fetterolf, Sr. et al. | 439/352 |
| 5,486,117 | | 1/1996 | Chang | 439/357 |
| 5,533,908 | | 7/1996 | Henry et al. | 439/329 |
| 5,545,052 | | 8/1996 | Hirai | 439/354 |
| 5,564,939 | * | 10/1996 | Maitani et al. | 439/357 |
| 5,749,746 | | 5/1998 | Tan et al. | 439/357 |
| 5,779,495 | | 7/1998 | Dechelette | 439/353 |

FOREIGN PATENT DOCUMENTS

| | | |
|---|---|---|
| 2 243 029 | 10/1991 | (GB) . |
| 2 254 199 | 9/1992 | (GB) . |

* cited by examiner

*Primary Examiner*—Paula Bradley
*Assistant Examiner*—Tho D. Ta
(74) *Attorney, Agent, or Firm*—Robert J. Zeitler

(57) ABSTRACT

A plug connector is provided having a mechanism to lock with a mated socket connector and to enhance grounding. The plug connector includes a movable latch having a retractable claw. The claw is received within a corresponding recess in the socket connector in an inserted condition to prevent unintentional removal. The latch is movably mounted within a rigid conductive shell of the plug connector. The latch has a pressing portion that is accessible through a first aperture in the shell, and the claw projects through a second aperture. A latch spring is disposed in the shell to bias the latch outwardly. In an embodiment, the spring is unitarily formed with two free ends that are normally slightly offset from one another. The free ends pass over each other with a slight "click" interference when the latch spring is deflected. At an opposite side of the plug connector, a grounding spring projects outwardly from a recess in the shell for also contacting a recess in the mated socket connector.

17 Claims, 8 Drawing Sheets

ELECTRICAL CONNECTOR WITH LOCKING MECHANISM AND METAL SPRING

BACKGROUND OF THE INVENTION

The present invention generally relates to the art of electrical connectors and more particularly relates to a mated plug and receptacle having a locking mechanism.

A plug connector is known wherein a shield is mounted to provide a predetermined gap around a periphery of terminals, the shield forming a contact with a mated socket connector, as disclosed in Japanese Examined Utility Model Application No. Hei 7-16312. In this known connector, the shield is constructed by forming a thin metal plate into an oblate rectangular shape in cross section. The resulting shield is intended to maintain physical contact strength between the connector and the socket by virtue of the spring elasticity of the metal of the shield frame.

Such known connectors generally include no lock mechanism. Therefore, the plug connector can be easily removed from the receptacle simply by pulling the connector body of the plug connector in a withdrawal direction away from the socket connector.

Such a non-locking connector arrangement may be sufficient for many personal consumer uses, such as a cable connection between a home personal computer and a digital video, wherein the inserting and withdrawal of the plug is frequently repeated. However, the non-locking arrangement may be insufficient to keep a satisfactory engagement in other environments which demand high reliability, and especially where the removal of the plug is not frequent. For example, a more reliable connection is desirable in commercial or business use, such as for a security camera in a bank or a store.

A need exists for a plug and socket connector with improved reliability. In particular, such a connector is needed which is releasably lockable to prevent inadvertent unpluging. Additionally, a connector is needed which provides a robust and stable connection.

SUMMARY OF THE INVENTION

A plug connector is proposed having a shield with locking mechanism. The locking mechanism includes a movable latch, the latch including a claw that projects outwardly from a side of the shield. A mated socket receptacle is also provided for receiving the plug connector. Upon plugging the plug connector into a mated socket receptacle, the projecting claw is received into a corresponding engagement recess formed in the socket receptacle.

Unfortunately, in some connector geometries, the plug connector may be able to move relative to the socket receptacle at the side opposite the single locking mechanism. From such movement, there is a possibility that the projection can work free from the recess, unlocking the connector. In order to prevent this, it has been considered to provide a connector with a pair of lock mechanisms on opposite sides. However, providing multiple locks on the connector unduly complicates the structure, raising manufacturing costs. Additionally, a dual-lock connector structure can lead to a rattle or wobble due to the fine positional displacement of the lock mechanisms. If such rattle is generated, the electrical connection between the shield and the receptacle is unstable.

Accordingly, features of the present invention enable a connector structure having a single locking mechanism to provide a stable connection and securely locked fit between the plug and socket receptacle. Additionally, the present invention advantageously reduces noise components upon the connection to the socket.

An additional feature of the invention is that it produces "click" or frictional feeling when the latch is pressed by a user. The structure of the connector is set so that the click corresponds to a depressed, unlocked condition of the claw relative to the recess in the socket receptacle. This sensory feedback is helpful to a person operating the plug, as it advantageously indicates that the plug can be withdrawn. In an embodiment, this click effect is performed by the latch spring. In particular, the latch spring is formed in a folded-over leaf shape such that two free ends of the spring are normally separated by a small gap, but as the spring is deflected as the latch is depressed, the two free ends of the spring physically contact each other and then pass over each other with slight interference. Advantageously, the spring according to this embodiment of the invention performs both the lock release "click" indicator function and the inherent spring function to bias the latch.

In an embodiment of the invention, a shielded electrical connector is provided having an insulative housing containing a plurality of terminal cavities, a plurality of terminals loaded into respective terminal cavities, and a conductive shell enclosing a portion of the housing. The conductive shell has a front opening to provide access for a mating connector. Additionally, a first side of the conductive shell has a first aperture and a second aperture. A latch disposed on the shell has a rear end pivotally mounted to shell. The latch further includes a push portion accessible through the second aperture in the shell and a claw projecting outwardly through the first aperture in the shell. A spring is disposed between the shield and latch for biasing the latch, and claw, outwardly.

In an embodiment, the connector further includes an inner shield that encloses the housing within the conductive shell.

For pivotally mounting to the shell, in an embodiment, latch includes a pair of oppositely-directed posts that pivotally reside in pivot holes in the shell.

In an embodiment, the connector additionally includes an insulative jacket around the conductive shell. This jacket is preferably formed of a flexible material, such as a rubber or plastic material. In an embodiment, the insulative jacket includes a flexible press portion abutting against the push portion of the latch. Advantageously, the insulative jacket protects the other components of the connector and allows the connector to be easily gripped while permitting manipulation of the latch.

In an embodiment, the latch is disposed between the conductive shell and the insulative jacket around the shell.

In an embodiment, the connector includes a biasing spring outwardly projecting from a second side of the shell. This biasing spring advantageously ensures a secure fit of the connector within a mated socket receptacle and a stable grounding connection.

In an embodiment, the receptacle connector includes a pushing spring that is biased against a face of the plug connector upon insertion, applying a force against the plug connector in the withdraw direction. This pushing spring advantageously keeps a side of the deployed claw held firmly against the recess in the socket receptacle, enhancing the locking action of the claw. Additionally, when the latch is depressed to release the plug connector, retracting the claw from the recess, the pushing spring advantageously boosts the plug connector in a withdrawal direction from the receptacle connector.

Additional features and advantages of the present invention are described in, and will be apparent from, the description, claims and Figures herein.

DETAILED DESCRIPTION OF THE PRESENTLY PREFERRED EMBODIMENTS

Figure 1:
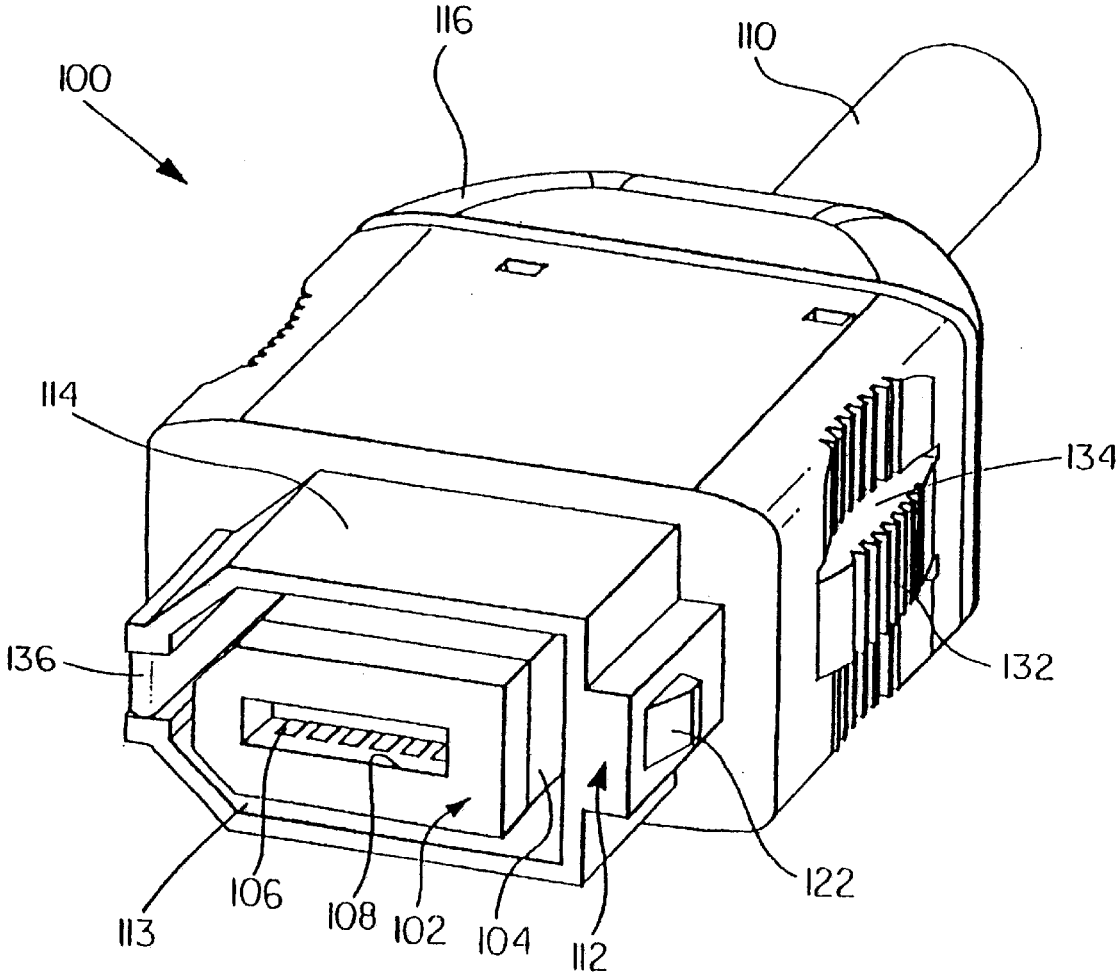
FIG. 1 is a perspective view of an electrical plug connector with a lock mechanism in accordance with an embodiment of the present invention.
Figure 2:
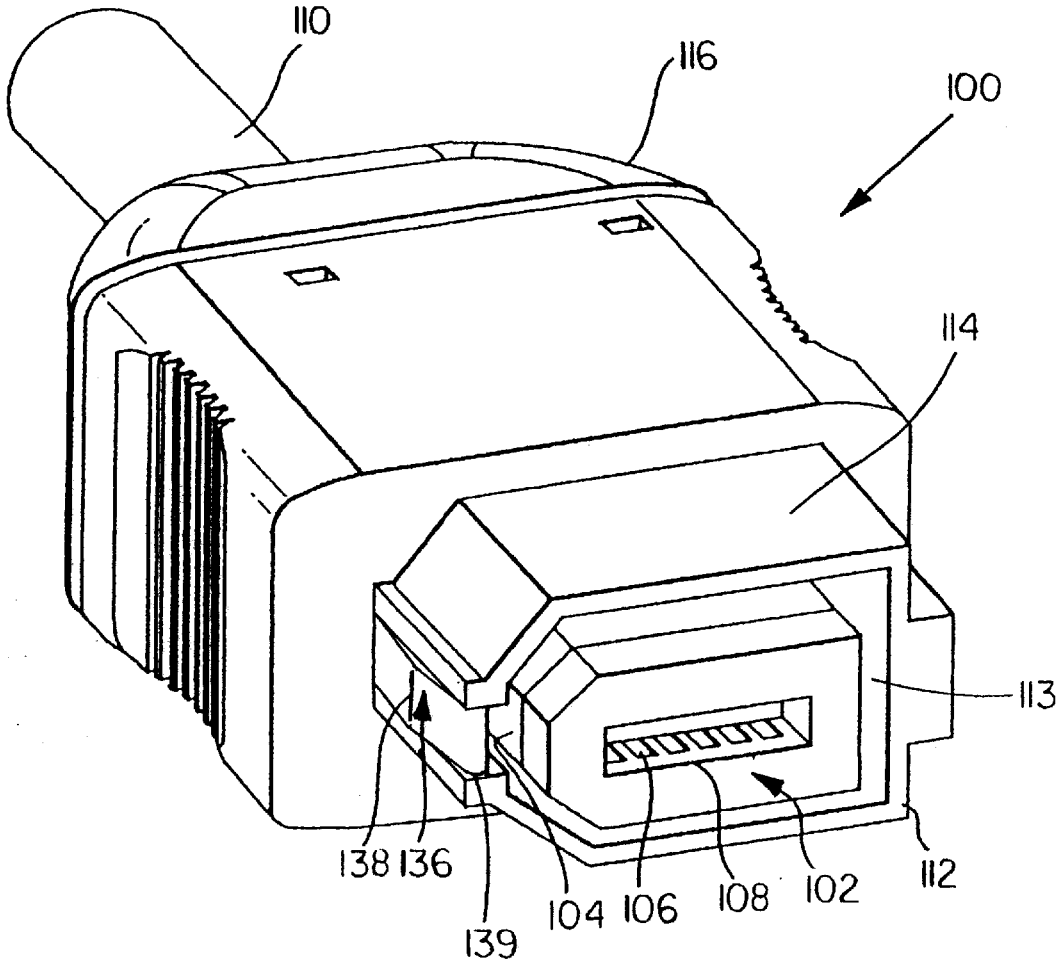
FIG. 2 is a perspective view of the electric connector of FIG. 1 as viewed from above another angle.
Figure 3:
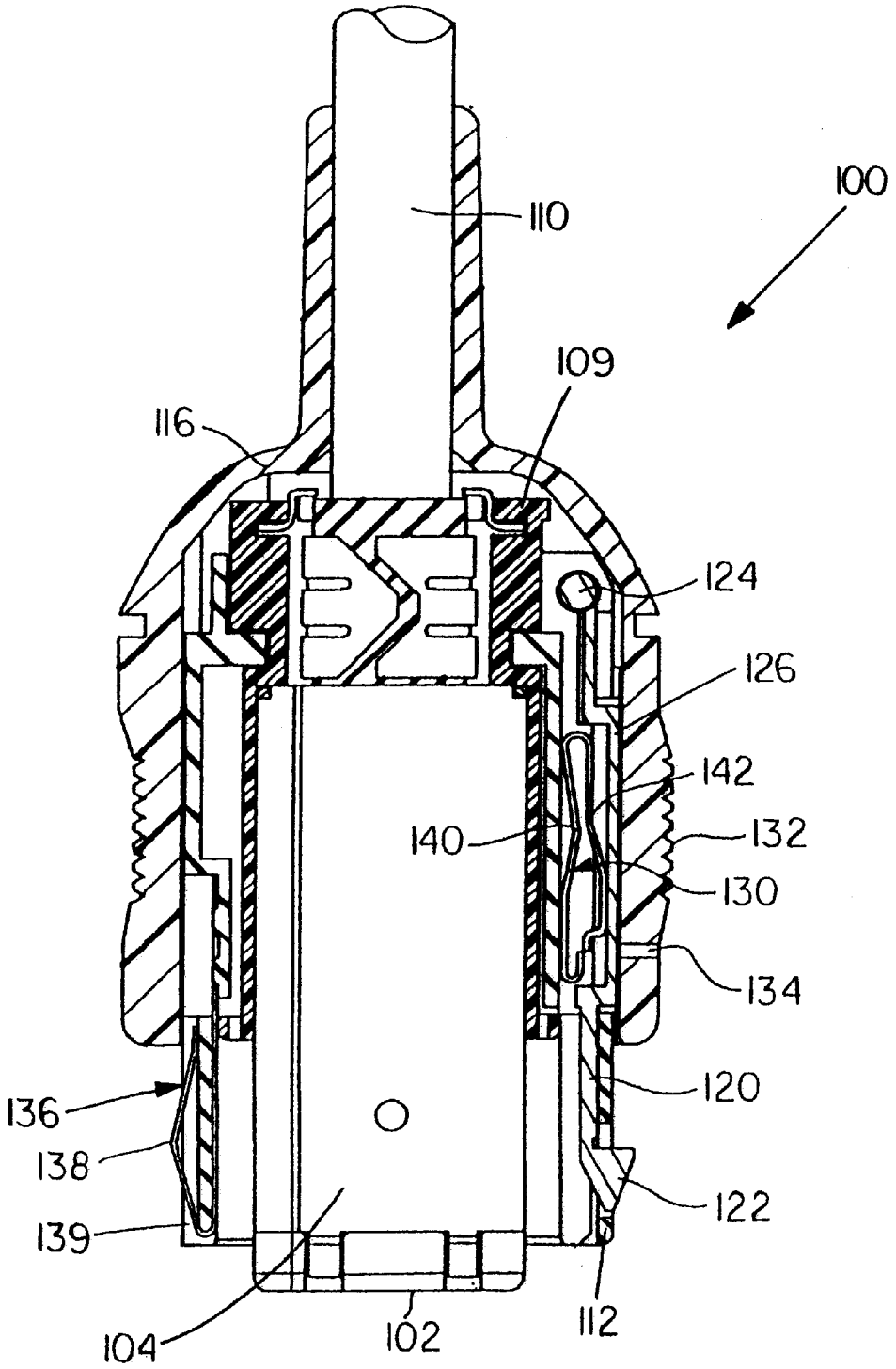
FIG. 3 is a cross-sectional view of the connector of FIGS. 1 and 2.
Figure 4:
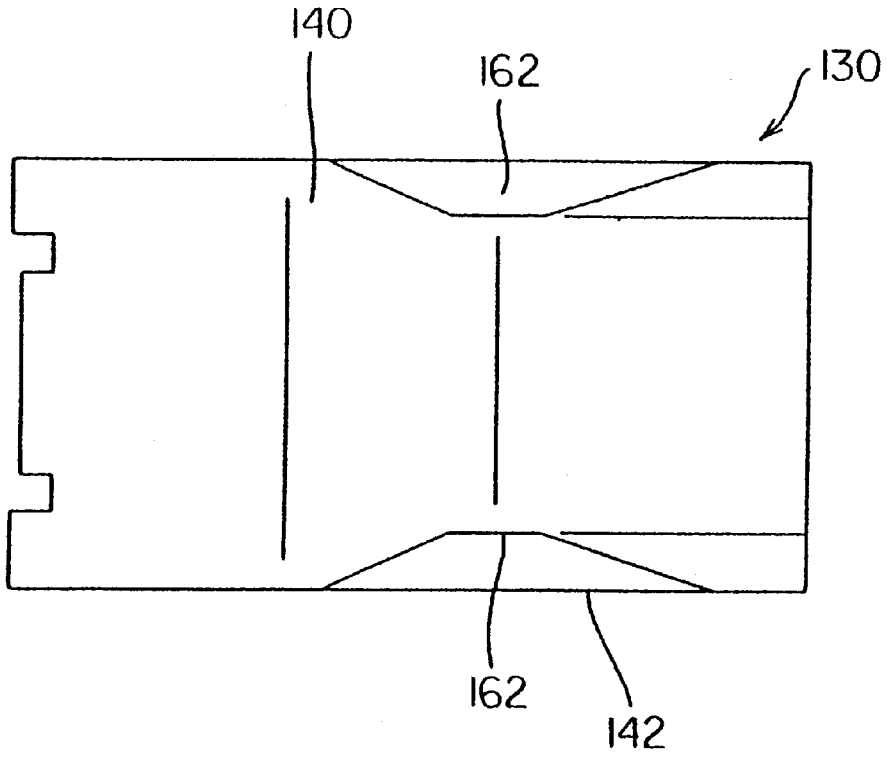
FIG. 4 is a plan view of a spring of the connector.
Figure 8:
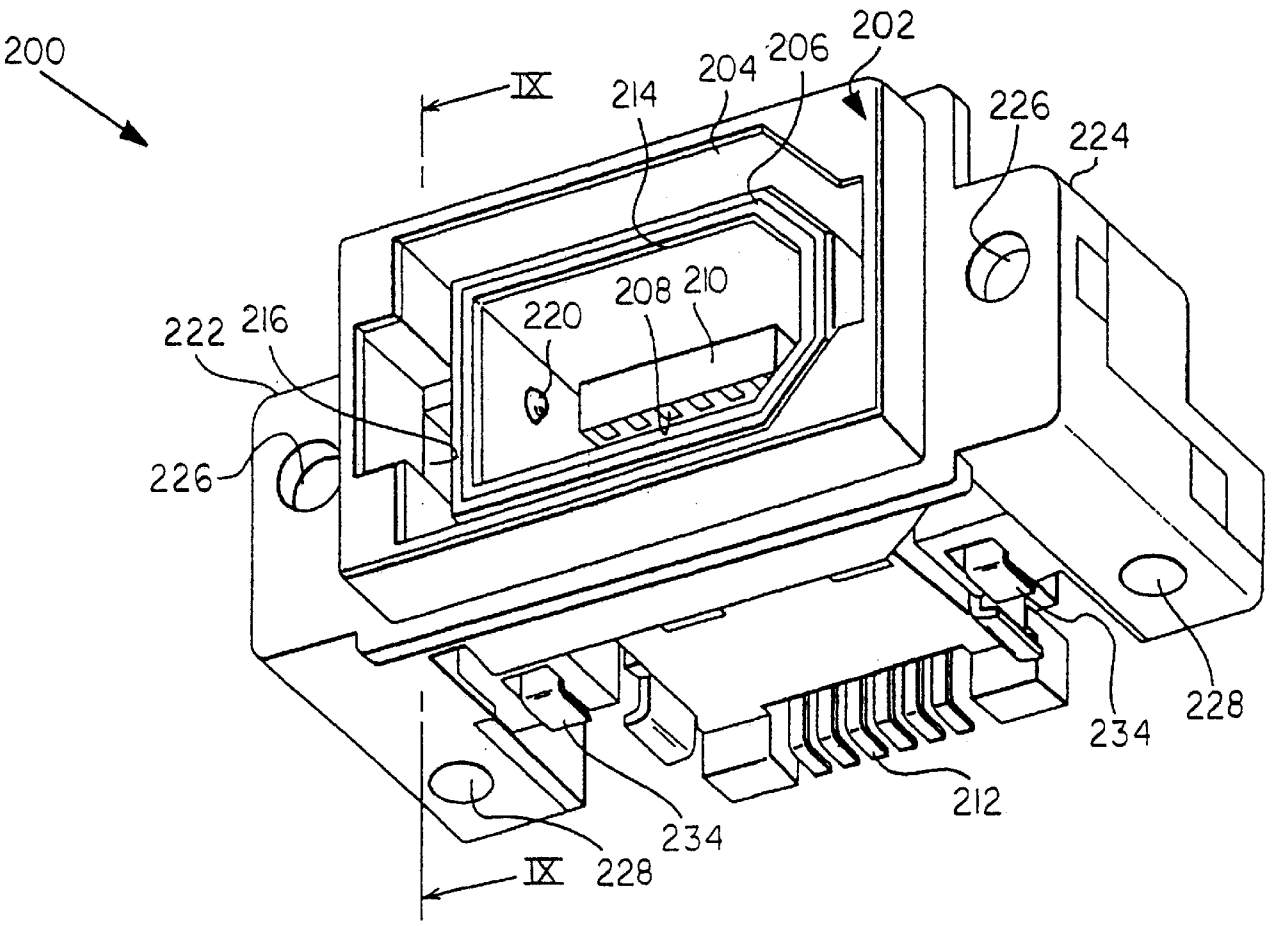
FIG. 8 is a perspective view of a complementary socket connector.
Figure 9:
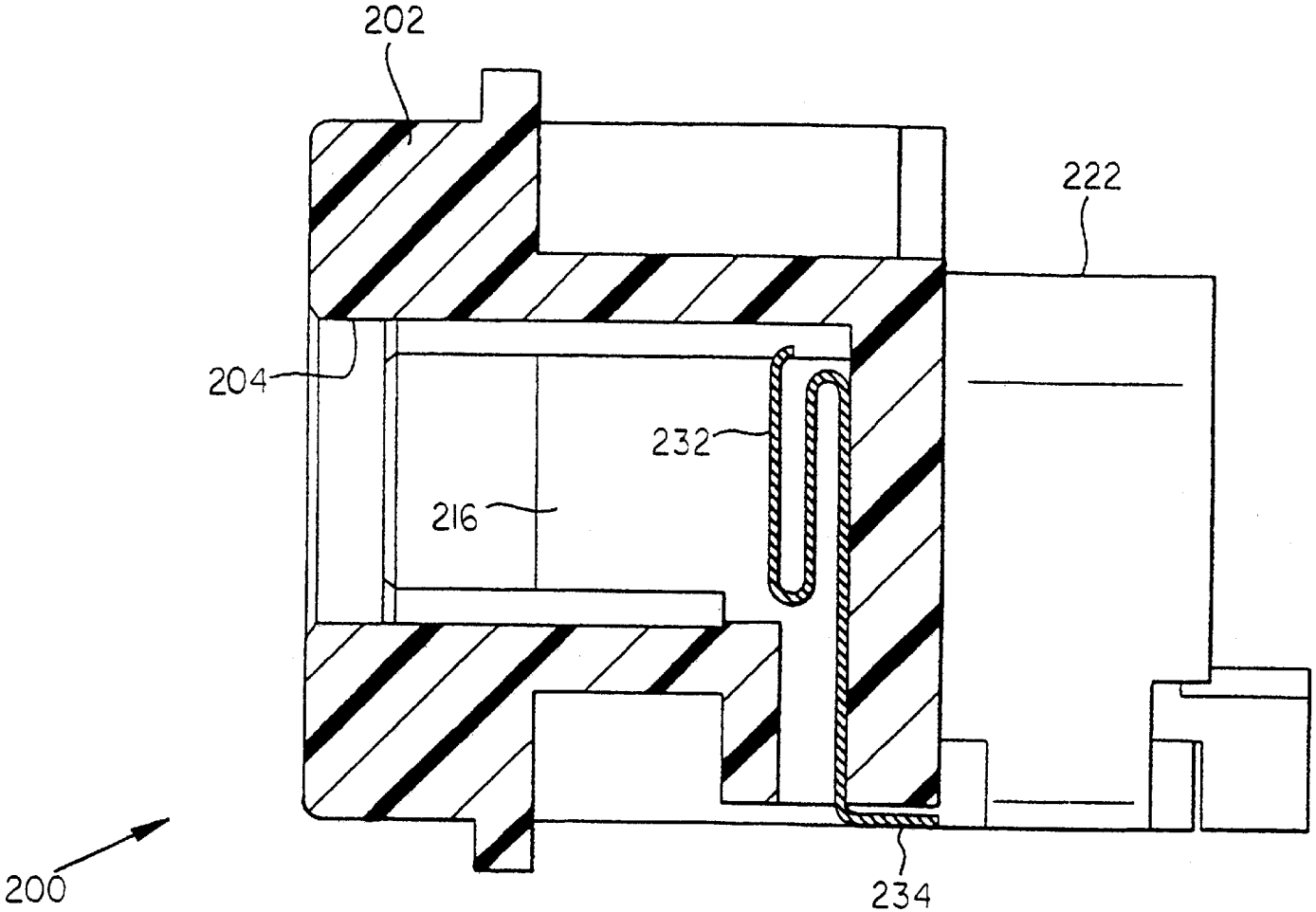
FIG. 9 is a cross-sectional of the socket connector as taken generally along line IX—IX of FIG. 8.

Now referring to the Figures, wherein like numerals designate like components, FIGS. 1–3 illustrate a plug connector 100 embodying features in accordance with teachings of the present invention. The illustrated connector 100 is a 1394-type connector, however, the present invention can be used with other types of connectors also. FIGS. 8 and 9 illustrate a corresponding socket connector 200 for matably receiving the plug connector 100. The plug connector 100 and socket connector 200 are illustrated in a mated condition in FIG. 10.

With reference to FIGS. 1 and 2, the plug connector 100 includes an insulative housing 102. To provide electromagnetic shielding, a conductive inner shield 104 is disposed peripherally around the housing 102. The housing 102 contains a plurality of terminal cavities which hold a plurality of respective conductive terminals 106. A terminal opening 108 is formed in the housing 102 for providing access to the terminals 106. An intermediate housing 109 (FIG. 3) is disposed outside of the inner shield. A cable 110, for example a coaxial cable, is mounted to a rear of the housing 102 for delivering a signal or power to or from the connector 100. The cable 110 contains conductive leads which are connected to the respective terminals 106.

Figure 10:
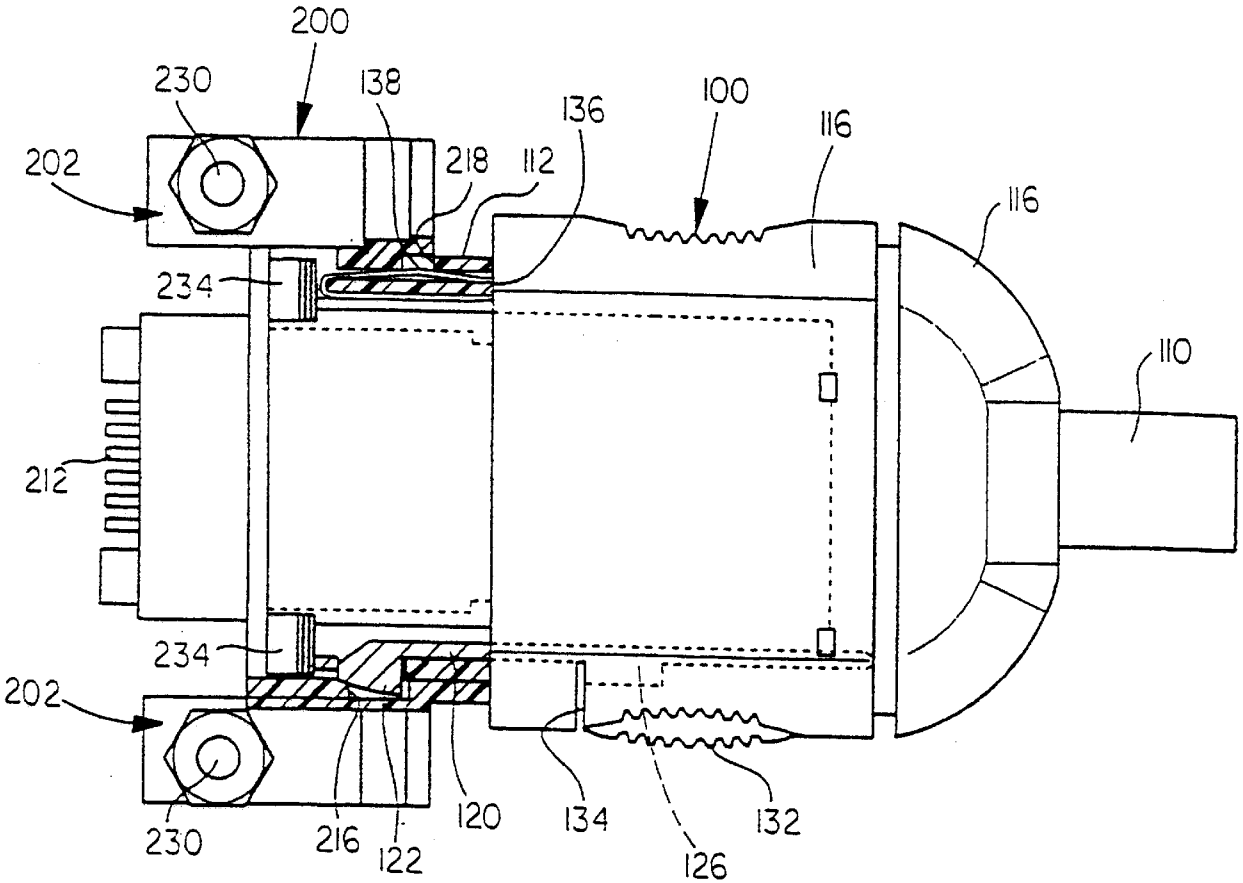
FIG. 10 is a partially sectional plan view, showing a grounded connector assembly including the plug connector mated with the socket connector.

For robust rigidity and electromagnetic shielding, the plug connector 100 includes a conductive shell 112, shown in FIGS. 1–3, which encloses a portion of the housing 102. An forward insertion portion 114 of the shell 112 has a front opening to provide access for the socket connector 200 (FIGS. 8–10). At a front portion of the plug connector 100, a gap 113 separates the conductive shell 110 and the housing 102. The conductive shell 112 is rigid and may be formed from a metal such as aluminum by die-casting or machining. The shell 112 preferably comprises a top component juxtaposed with a bottom component.

Still referring to FIGS. 1–3, for protection and gripping, the connector 100 additionally includes an insulative jacket 116 disposed exteriorly around the conductive shell 112. The jacket 116 is formed of a flexible material, such as a molded synthetic resin. The insertion portion 114 of the shell 112 extends forwardly of the jacket 116 to permit proper mated insertion with the socket receptacle 200 (FIGS. 8–10).

To releasably lock the plug connector 100 in accordance with an aspect of the invention, the plug connector 100 includes a movable latch 120, as illustrated in FIG. 3. The latch 120 is disposed between the housing 102 and the shell 112. A forward portion of the latch 120 forms a claw 122 that projects outwardly through a first aperture in the shell 112, as illustrated also in FIG. 1. As shown in FIG. 3, a rear end of the latch 120 , is movably mounted to the shell 112 at a pivot 124. More particularly, pivot 124 includes a pair of oppositely-directed posts that extend from opposite sides of the latch 120 and pivotally reside in corresponding pivot holes in the shell 112. Extending forwardly from the pivot 124, the latch 120 has a push portion 126 accessible through a second aperture in the shell 112. The latch 120 is formed of a rigid material, such as metal or hard plastic.

The latch 120 is movable on said pivot relative to the shell 112 to move the claw 122 selectively between an extended position, as illustrated in FIGS. 1 and 3, and a retracted position, wherein the claw 122 retracts through the corresponding aperture in the shell 112. In the illustrated embodiment, the claw 112 is ramp-shaped for one-way locking insertion. A latch spring 130 is disposed on the shell 112 between an outer wall of shield 112 and the latch 120 for normally biasing the latch 120 outwardly. The latch spring 130 is described in greater detail below in connection with FIGS. 4–7.

To release the claw 122 from the extended or locked position, a user can apply pressure on the push portion 126 of the latch 120, thereby moving the latch 120 against the bias of the latch spring 130 and retracting the claw 122. As shown in FIGS. 1 and 3, the jacket 116 preferably includes a press portion 132 that lies over the push portion of the latch, the press portion 132 of the jacket being defined by slots 134 for added flexibility.

For tight mating insertion and good grounding, the illustrated embodiment of the plug connector 100 includes a grounding spring 136 having a projecting portion 138 that normally projects from a recess 139 on an opposite side of the shell 112. The projecting portion 138 of the grounding spring 136 retracts into the recess 139 when met by a sliding force in the insertion direction exerted by the socket connector 200 upon mating, but maintains an outward bias.

Turning now to FIGS. 4 to 7, the latch spring 130 is illustrated in greater detail. The latch spring 130 is unitarily formed in a folded-over shape, having a first leaf 140 on one side, a second leaf 142 on the other side, joined by a U-shaped bend 144 (FIG. 5), and having a pair of respective free ends 146 and 148. In an embodiment, the spring 130 provides a convenient "click" or friction feeling corresponding to a retracted position of the locking claw 122 when the latch 120 (FIG. 3) is pressed by a user. This "click" feedback indicates to the user that the latch is released and that the plug connector 100 may be withdrawn. When residing in a normal position within the plug connector 100 to bias outwardly against the latch 120, as illustrated in FIG. 3, the free ends 146, 148 of the latch spring 130 are directed generally toward each, but are slightly offset relative to each other.

Figure 5:
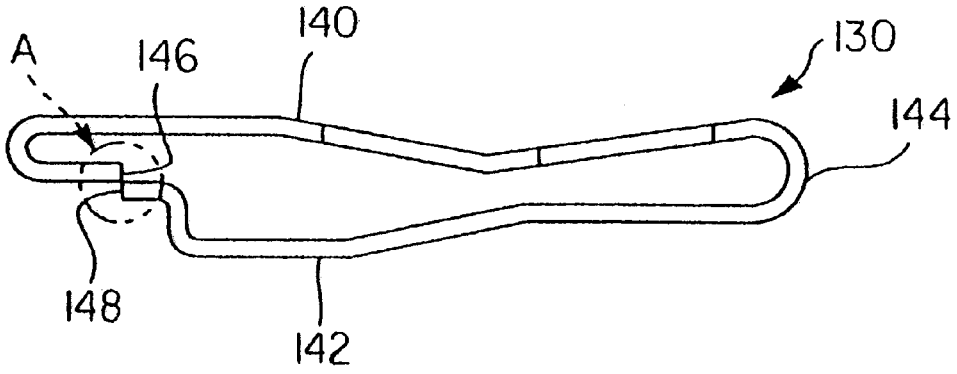
FIG. 5 is a side elevational view of the spring.
Figure 7:
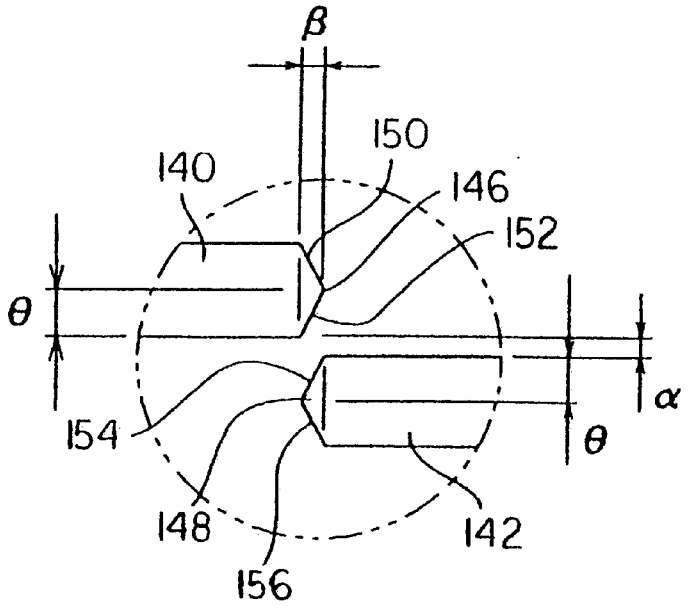
FIG. 7 is an enlarged fragmentary view of a the area of the spring indicated by circle A of FIG.5.

FIG. 7 is an enlarged view of the portion A of FIG. 5, illustrating the normal offset position of the free ends 146, 148 in greater detail, the free ends 146, 148 being slightly separated by a suitable gap a in an expansion/contraction direction. In a preferred embodiment, each of the free ends 146, 148 is tapered or crested in shape. More specifically, the free end 146 includes tapered surfaces 150 and 152, and the free end 148 includes tapered surfaces 154 and 156. The free ends 146, 148 overlap each other in an overlap dimension β, so that when the latch 120 (FIG. 3) is pressed, deflecting the spring 130, the free ends 146 and 148 move toward each other and contact against each other. The overlap dimension β is selected so that the continued deflection of the latch spring 130 causes the free ends 146, 148 to pass over each other with the desired slight frictional interference or "click." The tapered surfaces 150, 152, 154, 156 assist the free ends 146, 148 to ride over each other.

Figure 6:
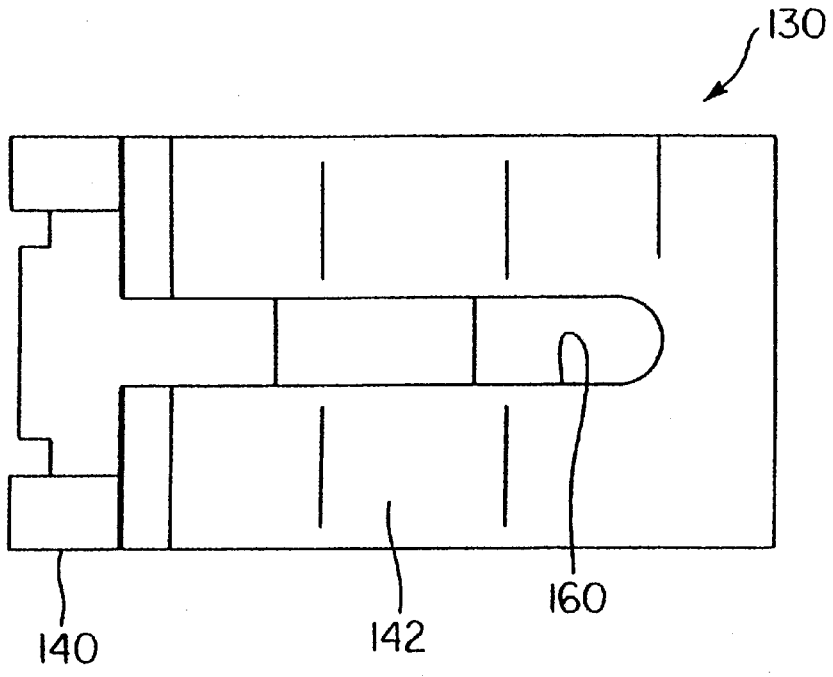
FIG. 6 is a base view of the spring.

A suitable latch spring 130, for example, may have a plate thickness (θ×2) of about 0.2 mm, the overlap length β is about 0.05 mm and the gap α is set at about 0.07mm. The latch spring 130 is formed of resilient spring metal. In an embodiment, the bias force of the latch spring 130 can be adjusted by cutting material from the spring 130. For example, as illustrated in FIG. 6, an oblong slot 160 is formed in the intermediate portion in the width direction the spring leaf 142. Also, for example, cutaway slots 162 may be formed on both sides in the width direction of the other spring leaf 140, to adjust the overall spring force as needed to provide a desired amount of resistance.

Now referring to FIG. 8, the socket connector 200 will be described in greater detail. The socket connector 200 includes an insulative socket body 202 defining an insertion port 204 at a front thereof shaped to receive the insertion portion 114 of the plug connector 100 (FIGS. 1–3). The socket body 202 forms guide sleeve 206 which projects forwardly within the insertion port 204, the guide sleeve 206 being shaped to fit within the gap 113 of the plug connector 100 (FIGS. 1–3) and to receive the forward portion of the housing 102 of the plug connector 100.

Also shown in FIG. 8, the socket body 202 defines a plurality of terminal cavities which hold a plurality of conductive terminals 208. The socket body includes a terminal platform 210 which projects forwardly within the guide sleeve 206 and on which contact portions of the terminals 208 are disposed. The terminal platform 210 is shaped to be received within terminal opening 108 of the plug connector 100 (FIGS. 1 and 2) so that the terminals 208 of the socket connector 200 contact the plug terminals 106. Tail portions 212 of the conductive terminals 208 project from a rear of the socket body 202 for connection to corresponding conducive pads on a circuit board. The socket connector 200 may be molded from a synthetic resin.

To provide electromagnetic shielding, as shown in FIG. 8, an inner shield 214 is disposed within the guide sleeve 206. When the insertion portion 114 of the plug connector 100 is inserted, the inner shield 214 comes into multi-surface contact with the inner shield 104 of the plug connector (FIGS. 1 and 2). Also, as illustrated in FIGS. 8 and 10, a recess 216 is provided in the socket body 202 at a position to lockably receive the locking claw 122 of the plug connector 100 (FIGS. 1–3). Another recess 218 is provided in the socket body 202 at an opposite side of the insertion port 204 to receive the grounding spring 136, as illustrated in FIG. 10. A portion of a conductive shield may be disposed in the recess 216 and/or 218. The claw 122 and grounding spring 136 each can serve to provide grounding contact between the plug connector 100 and the socket connector 200.

As shown in FIG. 8, a protuberance 220 is preferably formed on an inner surface of the above-described inner shield 214 at a position that serves as a pivot point when the external force is applied against the plug 100 when mated with the socket 200. In such a condition, it is also possible to keep a contact stability between the inner shield 104 of the plug connector 100 and the inner shield 214.

The socket body 202 forms mounting blocks 222 and 224 at opposite sides. A pair of screw apertures 226 may be provided in the socket body 202 in the insertion direction for securely mounting the socket connector 200. Also, a pair of screw apertures 228 may be provided in a perpendicular direction. Accordingly, the socket connector 200 may be mounted to a panel or on a circuit board. For example, as illustrated in FIG. 10, the socket body 202 is mounted on a circuit board (not shown) using a pair of screws 230 extending through the screw apertures 228.

To enhance the locking action of the claw 122 (FIGS. 1–3 and 10) and to aid in withdrawal of the plug connector 100 from the socket connector 200, as illustrated in FIG. 9, the socket connector 200 includes serpentine pushing springs 232. Each of the pushing springs 232 is mounted generally in the deepest portion of the insertion port 204. These springs 232 are preferably formed by bending a conductive metal plate into a Z-shape or serpentine shape. A front face of the plug connector 100 is brought into contact with the pushing springs 232 so that the pushing springs 232 bias against the plug connector 100 in the removal direction. As shown in FIGS. 8–10, a respective contact end 234 of each of the above-described pushing springs is bent in an L-shape and projects from the bottom surface of the above-described socket body 202. The spring ends 234 may be connected to a ground contact (not shown) of the circuit board by soldering or the like. This advantageously provides stable grounding to both the socket connector 200 and the plug connector 100 as enhanced by the grounding contact as a result of the claw 122 and the grounding spring 136 in grounding contact with grounded portions of the socket connector 200.

The present invention is not limited to the exemplary embodiments specifically described herein. To the contrary, it is recognized that various changes and modifications to the embodiments specifically described herein would be apparent to those skilled in the art, and that such changes and modifications may be made without departing from the spirit and scope of the present invention. Accordingly, the appended claims are intended to cover such changes and modifications as well.

What is claimed is:

1. A shielded electrical connector comprising:

an insulative housing containing a plurality of terminal cavities;

a plurality of terminals loaded into respective terminal cavities;

a conductive shell enclosing a portion of the housing, said conductive shell having a front opening to provide access for a mating socket connector; a first aperture in a first side of said conductive shell and a second aperture in the first side of said conductive shell;

a latch disposed on said shell, said latch having a rear end pivotally mounted on said shell, a push portion accessible through said second aperture in said shell and a claw projecting through said first aperture in said shell in a direction away from said housing; and a latch spring disposed against said latch for biasing said latch in a direction away from said housing.

2. The connector of claim 1, where in said latch has posts pivotally mounted in pivot holes in said shell.

3. The connector of claim 1 further comprising a grounding spring outwardly projecting from a second side of said shell.

4. The connector of claim 1, wherein said latch spring has two free ends normally disposed near each other such that when said latch is depressed against a bias of the latch spring, the free ends pass over each other, causing a click.

5. The connector of claim 1, further comprising an inner shield which partially encloses said housing within said conductive shell.

6. The connector of claim 5, wherein said latch is disposed between said conductive shell and an insulative jacket around said connector.

7. The connector of claim 6, wherein said spring is disposed between said conductive shell and said latch.

8. The connector of claim 1 including an insulative jacket around said conductive shell.

9. The connector of claim 8, wherein said insulative jacket includes a flexible press portion abutting against said push portion of said latch.

10. A shielded electrical connector comprising:

an insulative housing containing a plurality of terminal cavities;

a plurality of terminals loaded into respective terminal cavities;

a conductive shell enclosing a portion of the housing, said conductive shell having a front opening to receive a mating socket connector; a first aperture in a first side of said conductive shell and a second aperture in the first side of said conductive shell and a recess in a second side of said conductive shell;

a latch movably disposed in said shell, said latch having push portion accessible through said second aperture in said shell and a claw projecting through said first aperture in said shell in a direction away from said housing;

a latch spring disposed against said latch for biasing said latch in a direction away from said housing; and a grounding spring having a portion outwardly projecting from said recess for contacting said mated socket connector.

11. The connector of claim 10, where in said latch has posts pivotally mounted in pivot holes in said shell.

12. The connector of claim 10, wherein said latch spring has two free ends normally disposed near each other such that when said latch is depressed against a bias of the latch spring, the free ends pass over each other, causing a click.

13. The connector of claim 10, further comprising an inner shield which partially encloses said housing within said conductive shell.

14. The connector of claim 13, wherein said latch is disposed between said conductive shell and an insulative jacket around said connector.

15. The connector of claim 14, wherein said latch spring is disposed between said conductive shell and said latch.

16. The connector of claim 10, including an insulative jacket around said conductive shell.

17. The connector of claim 16, wherein said insulative jacket includes a flexible press portion abutting against said push portion of said latch.

* * * * *